US011288900B2

(12) United States Patent
Jiang et al.

(10) Patent No.: US 11,288,900 B2
(45) Date of Patent: Mar. 29, 2022

(54) METHOD OF ENHANCED COMPONENT FAILURE DIAGNOSIS FOR SUGGESTING LEAST PROBABLE FAULT

(71) Applicant: GM Global Technology Operations LLC, Detroit, MI (US)

(72) Inventors: Shengbing Jiang, Rochester Hills, MI (US); Xinyu Du, Oakland Township, MI (US); Yilu Zhang, Northville, MI (US); Varsha K Sadekar, Detroit, MI (US); Joshua J Sanchez, Sterling Heights, MI (US); Paul E Krajewski, Troy, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 312 days.

(21) Appl. No.: 16/561,711

(22) Filed: Sep. 5, 2019

(65) Prior Publication Data

US 2021/0074087 A1 Mar. 11, 2021

(51) Int. Cl.
*G07C 5/08* (2006.01)

(52) U.S. Cl.
CPC ..... *G07C 5/08* (2013.01)

(58) Field of Classification Search
CPC .... G07C 5/08; G07C 5/0825; G07C 2205/02; G07C 5/0808; G06F 17/18
See application file for complete search history.

(56) References Cited

U.S. PATENT DOCUMENTS

2013/0184929 A1* 7/2013 Salman ..... G05B 23/0283 701/31.5
2017/0039785 A1* 2/2017 Richter ..... G07C 5/0808
2019/0311558 A1* 10/2019 Bika ..... G07C 5/0841
2020/0372731 A1* 11/2020 Holland ..... B60W 50/0205

FOREIGN PATENT DOCUMENTS

WO WO-2011043966 A2 * 4/2011 ..... B61F 3/06

OTHER PUBLICATIONS

U.S. Appl. No. 16/418,587, filed May 21, 2019, Titled "Enhanced System Failure Diagnosis".

* cited by examiner

*Primary Examiner* — Thomas G Black
*Assistant Examiner* — Ana D Thomas
(74) *Attorney, Agent, or Firm* — Vivacqua Crane PLLC

(57) ABSTRACT

A method and system of diagnosing and suggesting least probable faults for an exhibited vehicle failure. The method includes initiating a vehicle health management (VHM) algorithm to monitor a state of health (SOH) for at least one vehicle component at each vehicle operating event over a predetermined time period. The VHM algorithm determines at least one of a Green SOH, a Yellow SOH, and a Red SOH designation with a confidence level for the at least one vehicle component; calculating a number of Green SOH designations ($N_{calculated}$) over the predetermined time period; and upon an exhibited vehicle failure, providing a least probable cause indication for the at least one component when a set of conditions are met. The set of conditions (Continued)

includes (i) $N_{calculated}$ is equal to or greater than a predetermined number of Green SOH designations and (ii) no Yellow SOH and Red SOH designations are present.

19 Claims, 4 Drawing Sheets

METHOD OF ENHANCED COMPONENT FAILURE DIAGNOSIS FOR SUGGESTING LEAST PROBABLE FAULT

The present disclosure relates to a vehicle health management (VHM) system, more particularly to a VHM system using a method of reducing the number of unnecessary component replacements by suggesting least probable faults.

Modern vehicles includes a host of vehicle sensors that monitors the systems and selected components within systems on the vehicle. A vehicle health management (VHM) system collects and processes data from the vehicle sensors and analyzes and transforms the data into operational support information to identify the current state of health (SOH) of the vehicle systems and components, enhanced vehicle safety and reliability, and help enable optimized maintenance actions. When the VHM system is located in, or integrated into the vehicle, the health management system may be referred to as an integrated vehicle health management (IVHM) system.

Often, when a vehicle exhibits a problem, a technician usually begins by inspecting and replacing vehicle components that most likely contributed to the problem until the problem is resolved. For example, a common vehicle problem such as when the vehicle will not start, a service technician would initiates a diagnostic process that begins with manually inspecting the vehicle battery as a potential cause of the problem. The vehicle battery is inspected first because it is usually the most common reason for the vehicle failing to start. The battery is then replaced if there is any indication that the battery may be the cause of the problem.

The result of the inspection may indicate the battery is the cause of the problem if the battery has lost its charge, however it might not be the root cause. The service technician may proceed with replacement of the battery, only to find that the vehicle still will not start. Now, the technician must move on to look at other potential causes for the vehicle not starting. This results in wasted time for the service technician, increased warranty cost due to having the non-faulty battery replaced, and inconvenience to the customer.

Thus, while current VHM systems achieve their intended purpose for monitoring the current SOH of the vehicle systems and component, there is a need for a VHM System that suggests least probable faults when the VHS system detects a potential vehicle problem in order to reduce the number of unnecessary component replacements to resolve the vehicle problem.

SUMMARY

According to several aspects a method of diagnosing a least probable cause failure for an exhibited vehicle failure is provided. The method includes initiating a vehicle health management (VHM) algorithm to monitor a state of health (SOH) for at least one vehicle component at each ignition event over a predetermined time period, wherein the VHM algorithm determines at least one of a Green SOH, a Yellow SOH, and a Red SOH designation for the at least one vehicle component together with the confidence level of each SOH designation; recording the Green SOH, the Yellow SOH, and the Red SOH designations and their confidence levels over the predetermined period of time; retrieving the Green SOH, the Yellow SOH, and the Red SOH designations along with their confidence levels over the predetermined period of time upon an exhibited vehicle failure; and calculating a number of Green SOH designations ($N_{calculated}$) over the predetermined time period; and issuing a least probable cause suggestion for the at least one component when predetermined conditions are met. The predetermined conditions include (i) the calculated number of Green SOH designations ($N_{calculated}$) is equal to or greater than a predetermined value and (ii) no Yellow SOH and Red SOH designations are present.

According to another aspect of the present disclosure, the method further includes partitioning the predetermined time period into partitioned time intervals and filtering out duplicate Green SOH, the Yellow SOH, and the Red SOH designations within a partitioned time interval. The predetermined time period is a running 30 day period and the partitioned time intervals are 24 hour periods According to another aspect of the present disclosure, the method further includes determining a time gap, wherein the time gap is a maximum number of consecutive partitioned time intervals without any SOH designation. The predetermined conditions further include (iii) the number of consecutive partitioned time intervals without a Green SOH designation is less than a predetermined value.

According to another aspect of the present disclosure, wherein $N_{calculated}$ is calculated using $N_{Calculated}=(N_{Total}-N_{Before})$. $N_{Before}$ is the number of Green SOH designations before the time gap. $N_{Total}$ is the total number of Green SOH designations over the predetermined time period.

According to another aspect of the present disclosure, $N_{calculated}$ is calculated using $N_{calculated}=[N_{Before}\times f(T)]+N_{After}$. $N_{Before}$ is the number of Green SOH designations before the time gap. $N_{After}$ is the number of Green SOH designations after the time gap. f(T) is a monotonically decreasing function with $0<=f(T)<=1$, e.g., $f(T)=1-T/T1$ wherein T is the size of the time gap.

According to another aspect of the present disclosure, $N_{calculated}$ is calculated using $N_{calculated}=N_{Total}$ when the time gap is less than a predefined value and the confidence level of the green SOH designations after the gap is above a predetermined threshold value. $N_{Total}$ is the total number of Green SOH designations over the predetermined time period. $N_{After}$ is the number of Green SOH designations after the time gap. The confidence level of the green SOH designations after the gap is the minimum of the confidence levels of all the green SOH designations after the gap.

According to another aspect of the present disclosure, the method further includes determining if there are missing SOH designations over the predetermined time period. The predetermined conditions further include (iv) no missing SOH designation is present.

According to another aspect of the present disclosure, the method further includes determining if there are any subsystem alerts over the predetermined time period. The predetermined conditions further include (v) no subsystem alerts are present.

According to another aspect of the present disclosure, the method further includes manually inspecting the at least one component for visible faults. The predetermined conditions further include (vi) no visible faults are found.

According to several aspects, a method of diagnosing and suggesting least probable faults for the cause of the exhibited vehicle failure is provided. The method includes initiating a vehicle health management (VHM) algorithm to monitor a state of health (SOH) for at least one vehicle component at each ignition event over a predetermined time period, wherein the VHM algorithm determines at least one of a Green SOH, a Yellow SOH, and a Red SOH designation for the at least one vehicle component; calculating a number of Green SOH designations ($N_{calculated}$) over the predetermined time period; and upon an exhibited vehicle failure, providing a least probable cause indication for the at least one component when a set of conditions are met. The set of conditions include (i) the calculated number of Green SOH designations ($N_{calculated}$) is equal to or greater than a predetermined number of Green SOH designations and (ii) no Yellow SOH and Red SOH designations are present.

In an additional aspect of the present disclosure, the method further includes determining a maximum number of consecutive partitioned time intervals without any SOH designation. The set of conditions further includes (iii) the number of consecutive partitioned time intervals without any SOH designation is less than a predetermined number of partitioned time intervals.

In another aspect of the present disclosure, the method further includes determining a number of missing SOH designations over the predetermined time period. The set of conditions further includes (iv) the number of missing SOH designations is less than a predetermined value.

In another aspect of the present disclosure, the method further includes determining if there are any subsystem alerts over the predetermined time period. The set of conditions further includes (v) no subsystem alerts are present.

In another aspect of the present disclosure, the method further includes visually inspecting the at least one component for faults. The set of conditions further includes (vi) no visible faults are found.

In another aspect of the present disclosure, $N_{calculated}$ is calculated using at least one of the following equations:

$$N_{Calculated}=(N_{Total}-N_{Before}); \quad \text{(i)}$$

$$N_{calculated}=[N_{Before}\times f(T)]+N_{After}; \text{ and} \quad \text{(ii)}$$

$$N_{calculated}=N_{Total} \quad \text{(ii)}$$

when the time gap is less than a pre-defined value and the confidence level of the green SOH designations after the gap is above a predetermined threshold value.

Wherein $N_{Total}$ is the total number of Green SOH designations over the predetermined time period; $N_{Before}$ is the number of Green SOH designations before the time gap; $N_{After}$ is the number of Green SOH designations after the time gap; and f(T) is a monotonically decreasing function with $0<=f(T)<=1$, e.g., $f(T)=1-T/T1$ wherein T is the size of the time gap.

According to several aspects, an integrated vehicle health management system (IVHMS) for a vehicle is provided. The IVHMS includes a component sensor configured to collect information from a vehicle component and a controller in electronic communication with component sensor. The controller is configured to initiate a vehicle health management (VHM) algorithm to monitor a state of health (SOH) for at least one vehicle component at each ignition event over a predetermined time period, wherein the VHM algorithm determines at least one of a Green SOH, a Yellow SOH, and a Red SOH designation for the at least one vehicle component; calculate a number of Green SOH designations ($N_{calculated}$) over the predetermined time period; and upon an exhibited vehicle failure, provide a least probable cause indication for the at least one component when a predetermined set of conditions are met In an additional aspect of the present disclosure, the IVHMS further includes a human machine interface (HMI) in communication with the controller. The least probable cause indication is displayed on the HMI.

In another aspect of the present disclosure, the controller is located apart from the vehicle and the controller is in wireless electronic communication with component sensor.

In another aspect of the present disclosure, the predetermined set of conditions includes (i) the calculated number of Green SOH designations ($N_{calculated}$) is equal to or greater than a predetermined number of Green SOH designations; (ii) no Yellow SOH and Red SOH designations are present.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses. The illustrated embodiments are disclosed with reference to the drawings, wherein like numerals indicate corresponding parts throughout the several drawings. The figures are not necessarily to scale and some features may be exaggerated or minimized to show details of particular features. The specific structural and functional details disclosed are not intended to be interpreted as limiting, but as a representative basis for teaching one skilled in the art as to how to practice the disclosed concepts.

Figure 1:
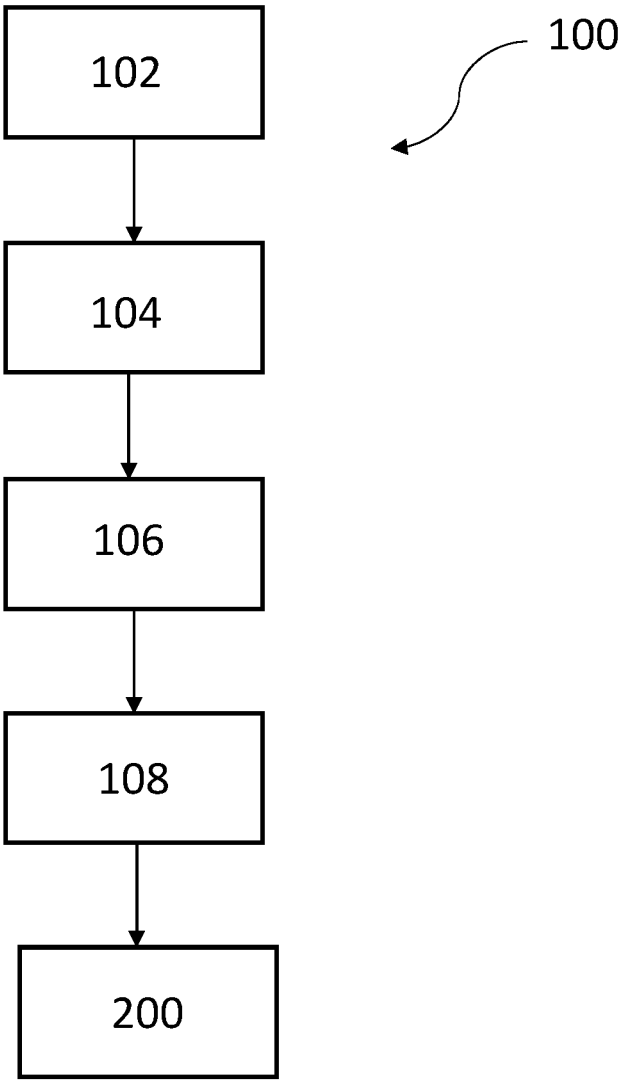
FIG. 1 is a Block diagram of a method of diagnosing and suggesting least probable faults for the cause of an exhibited vehicle failure, according to an exemplary embodiment.

Referring to FIG. 1, a Block diagram of a method of diagnosing an exhibited vehicle failure for suggesting least probable faults for the cause of the exhibited vehicle failure (method 100), of an exemplary embodiment of the present disclosure is shown. The method 100 evaluates the operating parameters for at least one vehicle component, such as the battery of a vehicle, and gives the vehicle component a state of health (SOH) designation of Green, Yellow, or Red for the component and provides a confidence level for the SOH designation provided. A Green designation is an indication that the vehicle component is operating as expected. A Yellow designation is an indication that the vehicle component is operating with reduced functionality. A Red designation is an indication that the vehicle component has failed. Upon an exhibited vehicle failure, the method 100 analyzes and records the SOH designations and respective confidence levels of the vehicle component to determine whether the vehicle component is a least probable fault for the cause of the exhibited vehicle failure.

Starting at Block 102, the method 100 includes initiating a vehicle health management (VHM) algorithm typically utilized in an integrated vehicle health management system (VHS) for a motor vehicle. It is preferable that the VHM algorithm is initiated whenever the engine of the vehicle is started, such as when an operator of the vehicle turns a key or pushes a button within the vehicle or on a remote device to start the engine. Each time the vehicle is started or attempted to start is referred to as an ignition event.

Upon a predetermined vehicle operating event such as an ignition event, the VHM algorithm collects information from sensors within the vehicle to monitor performance characteristics of various components within the vehicle. The VHM algorithm determines the SOH designations, together with the confidence levels of the SOH designations, for the various components. The VHM algorithm predicts failures in such components by monitoring the health of the vehicle components including tracking deteriorating or failing performance of the vehicle components. VHM algorithms utilized in IVHMS for motor vehicles for determining SOH designations and corresponding confidence levels are known in the art. Such VHM algorithms may be vehicle system or vehicle components specific.

Moving to Block 104, the date and time of each ignition event and SOH of the various monitored components for each ignition event along with the confidence level are recorded over a predetermined time period (T1), preferably a running 30 day period. In other words, the date and time of each ignition event is recorded and the determined SOH designations for various monitored components are retained for the previous 30 days, after which the determined SOH designations may be archived or deleted.

Moving to Bock 106, the method 100 then partitioned the predetermined time period (T1) into predetermined time intervals. It is preferable that the running 30 day period (predetermined time period) are partitioned into consecutive 24 hour time intervals (predetermined time intervals). At each ignition event within a 24 hour time interval, the VHM algorithm runs continuously for as long as the engine is running and monitors multiple components and systems of the vehicle, as well as associated diagnostic data (e.g., detected faults or past failures) and prognostic data (e.g., remaining useful life or incipient failures), to give the components and systems a SOH designation of Green, Yellow, or Red. For a 24 hour time interval, there may be no ignition event or there may be multiple ignition events. For example, there would be no ignition event if the vehicle is parked with the engine off for the 24 hour time interval or there may be multiple ignition events if the vehicle is started and stopped multiple times during the 24 hour time interval.

Moving to Block 108, the method further includes totalizing the Green SOH, Yellow SOH, and Red SOH designations as determined by the VHM algorithm for at least one vehicle component for each 24 hour time interval. It is preferable that each ignition event has a SOH designation. However, it should be appreciated that the VHM algorithm may not determine a SOH designation for every ignition event due to insufficient run time, sensor malfunctions, insufficient collection of data, etc. The numbers of Green SOH results are totalized for each discrete 24 hour interval. The number of Green SOH results are also calculated for the overall running 30 day period.

An indication of the likelihood that the at least one vehicle component is a root cause of the vehicle failure is only given in circumstances where there is compelling information to that effect. Therefore, no indication of the likelihood that the at least one vehicle component is a root cause of the exhibited vehicle failure is given when the number of consecutive Green SOH designations for the at least one vehicle component is less than a predetermined threshold over the predetermined time period (for example 30 days), within a certain number of consecutive time interval (for example 3 consecutive days), or within a discrete time interval (for example 24 hour period).

Errors in data collection may affect in determining the likelihood whether the monitored component is a root cause for a vehicle problem. By way of example only, the predetermined number of consecutive Green SOH may have occurred over a short period of time, such as over less than a 24 hour period. By way of another example, there may be missing data as suggested where the total number of ignition events are greater than the number of SOH designations. By way of still another example, vehicle component fault occurs after the last ignition event but have not yet been detected by the VHM algorithm.

Figure 2:
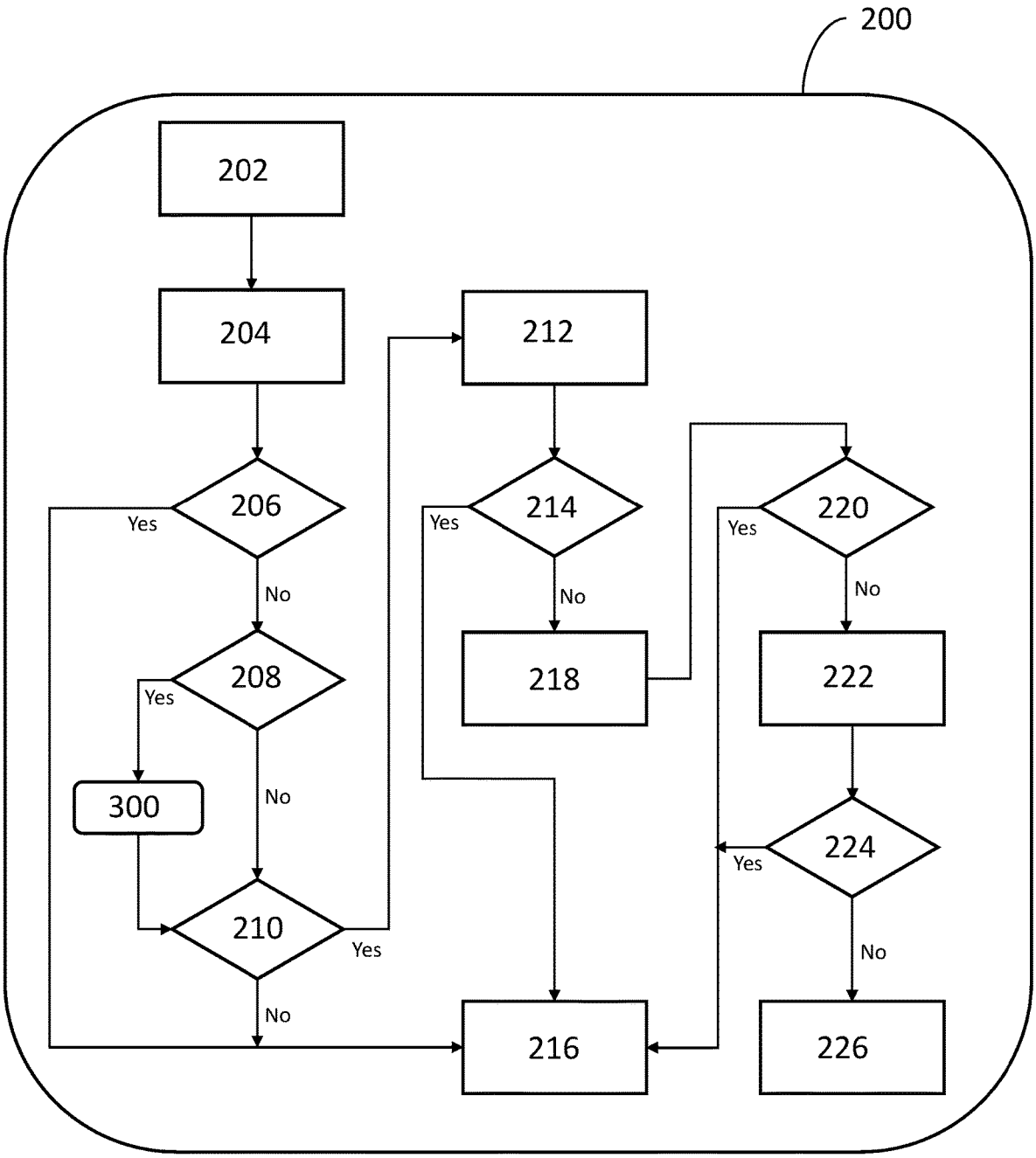
FIG. 2 is a flow chart illustrating the operation of the Block 200 shown in FIG. 1, according to an exemplary embodiment.

Upon an exhibited vehicle failure detected by the VHMS or by an operator of the motor vehicle or vehicle technician, the method proceeds to Block 200 for analyzing the SOH designations for suggesting a least probable cause for monitored components. Referring to FIG. 2, starting at Block 202 the vehicle data, including the SOH designations within the predetermined time period (T1) for the various monitored vehicle components, are retrieved. It is preferable that $T_1$ is the most recent 30 days of recorded VHM determinations. By way of non-limiting example, one of the various monitored vehicle components is that of a vehicle battery, which will be used to further describe the Block 200. The VHM algorithm, via sensors within the vehicle, monitors operating parameters of the battery. Operating parameters that may be monitored for the vehicle battery includes state of charge, open circuit voltage, minimum crank voltage, crank time, and battery internal resistance. Measurement of these operating parameters allow the VHM algorithm to evaluate the over-all health of the vehicle battery and to provide a SOH designation for the battery.

Moving to Block 204, less meaningful data for the vehicle battery are filtered out. Less meaningful data includes duplicate VHM determinations within a predetermined short period of time such as within an hour. Such duplicate data within a short period of time may be the result of the vehicle operator or technician repeatedly attempting to start the vehicle.

Moving to determination Block 206, if there are any SOH designations that is Yellow or Red, then the method moves to Block 216 where a least probable cause is not issued and the method ends. At decision Block 206, if there are no SOH designations that are Yellow or Red, then the method moves to decision Block 208.

Figure 3:
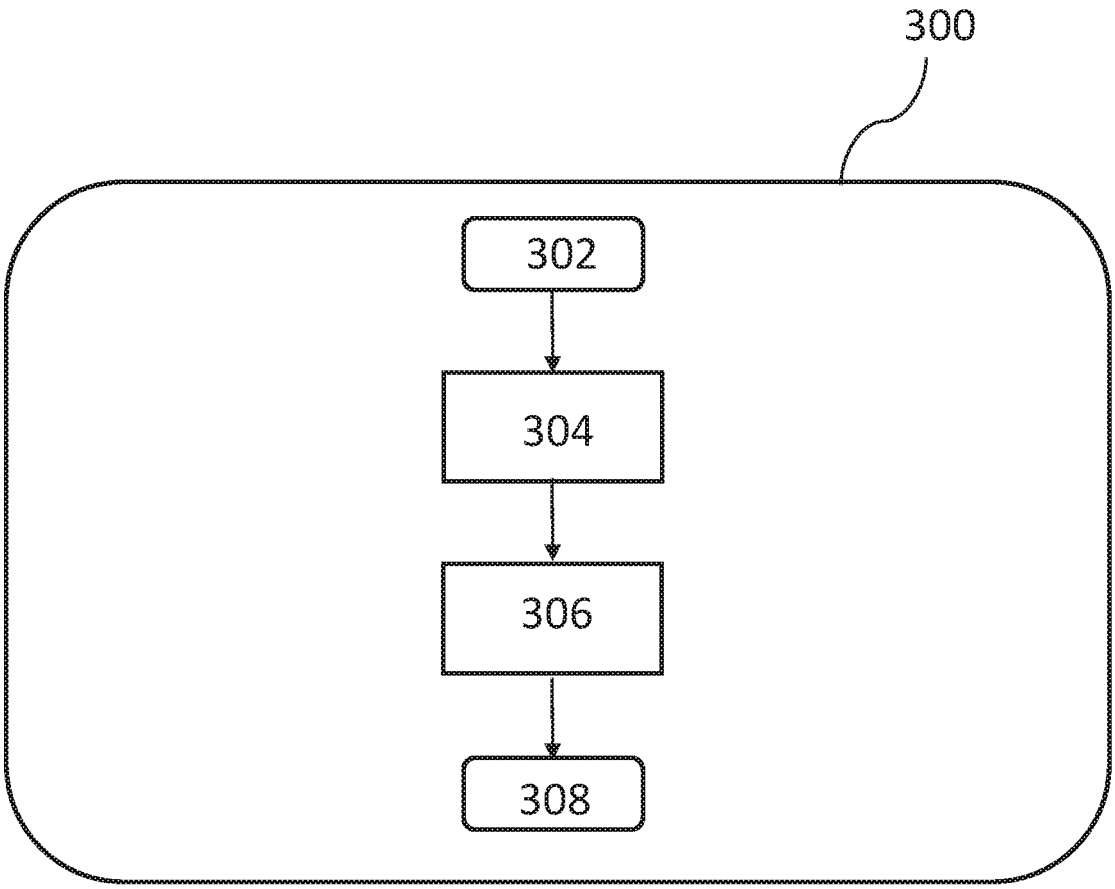
FIG. 3 is a flow chart illustrating the operation of the Subroutine 300 shown in FIG. 2, according to an exemplary embodiment.

At decision Block 208, if there are any consecutive time Intervals equal to or greater than a predetermined time value (T2) without a SOH decision, then the flow chart continues to Subroutine 300. Two or more consecutive time intervals without a SOH decision is referred to as a time gap (T). It is preferably that the time value (T2) is three (3) days. Referring to FIG. 3, a flow chart of the Subroutine 300 is presented. The Subroutine 300 starts in Block 302 moving to Block 304. At Block 304, a time gap T (i.e. greater or equal to 3 days) is selected and an $N_{Total}$ is set as the totalized number of Green SOH designations over the 30 day period.

Figure 4:
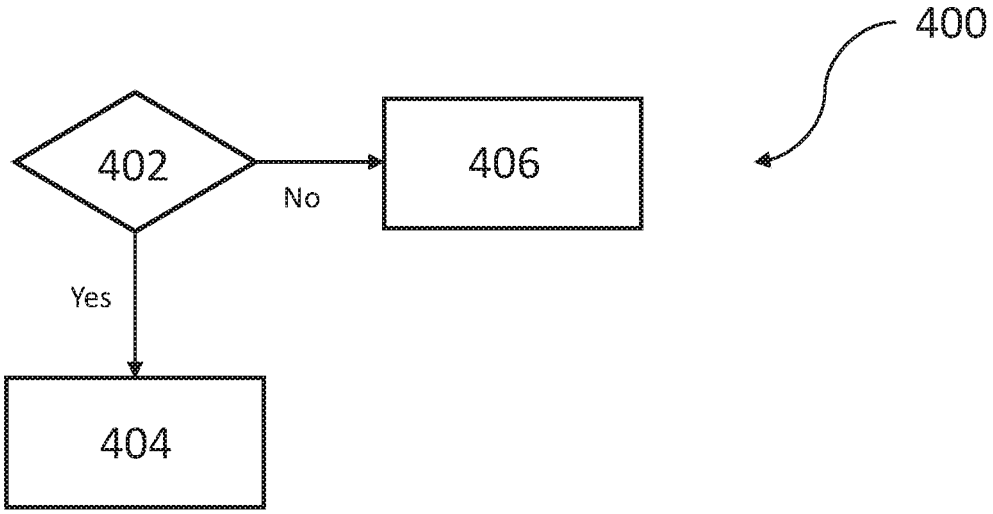
FIG. 4 is a flow chart illustrating an option in determining a parameter for Subroutine 300, according to another exemplary embodiment.

Moving to Block 304 using at least one of the following three options, a value of green SOH designations (N) is calculated ($N_{calculated}$). For Option 1, $N_{calculated}$ is equal to the total number of Green SOH designations in the predetermined time period ($N_{Total}$) minus the total number of Green SOH designations before the time gap ($N_{Before}$), expressed as $N_{Calculated}=(N_{Total}-N_{Before})$. In Option 2, $N_{calculated}=[(N_{Before})\times f(T)]+[\text{Number of Green SOH desig-}$ nations after the time gap ($N_{After}$)]. Where f(T) is defined as a monotonically decreasing function with 0<=f(T)<=1, for example, f(T)=1−T/T1, wherein T is the amount of time in the time gap, also referred to as size of the time gap. In Option 3, referring to FIG. 4, at decision Block 402, if T is less than a predetermined time interval value (preferably 7 days) and the Green SOH designations have a high consolidated confidence level (preferably greater than 90% or 95% confidence level) after the time gap, then $N_{calculated}$ is equal to ($N_{Total}$) in Block 404. The consolidated confidence level may be one of a minimal confidence level within a group of Green SOH confidence levels after the time gap, a maximum confidence level within the group of Green SOH confidence levels after the time gap, and an average of the group of Green SOH confidence levels after the time gap. Otherwise, $N_{calculated}$ is equal to $N_{Total}-N_{Before}$ in Block 406.

Referring back to FIG. 2, moving to decision Block 210 from Subroutine 300 or from Block 208, if $N_{calculated}$ is equal to or greater than a predetermined N value then the method moves to Block 212. The predetermined N value is preferably 20 Green SOH designations. Otherwise the method moves to Block 216 where a least probable cause notification is not issued and the method ends.

Moving to Block 212 from Block 210. At Block 212, the totalized number of VHM determinations recorded within the predetermined time period T1 (i.e. 30 days) are compared with the totalized number of ignition events recorded within the predetermined time period T1.

Moving to decision Block 214, if the total number of ignition events is greater than the VHM determination then there is an indication of missing VHM determinations, resulting in the method moving to Block 216 where a least probable cause is not issued and the method ends. If there are no indications of missing VHM determinations, then the method moves to Block 218 where any alerts, such as the subsystem-related diagnostic trouble codes (DTC), parameter identifier (PID), and other alerts such as the battery saver mode information (BSM), within the predetermined time period T1 are retrieved.

Moving to decision Block 220 if any alerts occurred, then the method moves to Block 216 where a least probable cause notification is not issued and the method ends. If no alerts occurred, then the method moves to Block 222. At Block 222, the technician is prompted to conduct a manual check for any visual indication of faulty components, such as cracks or leaks in the case of a vehicle battery.

Moving to decision block 224 from Block 220, if there is any faults found from the manual inspection, then the method moves to Block 216 where a least probable cause is not issued and the method ends. If no visual faults are found from the manual inspection, then the method moves to Block 226 where a least probable cause is issued. The least probable cause notification is issued with high confidence if the $N_{Calculated}$ is equal to or greater than a predetermined value, preferable 40 or greater, and the confidence level is equal to or greater than predetermined value, preferably greater than 70%.

Figure 5:
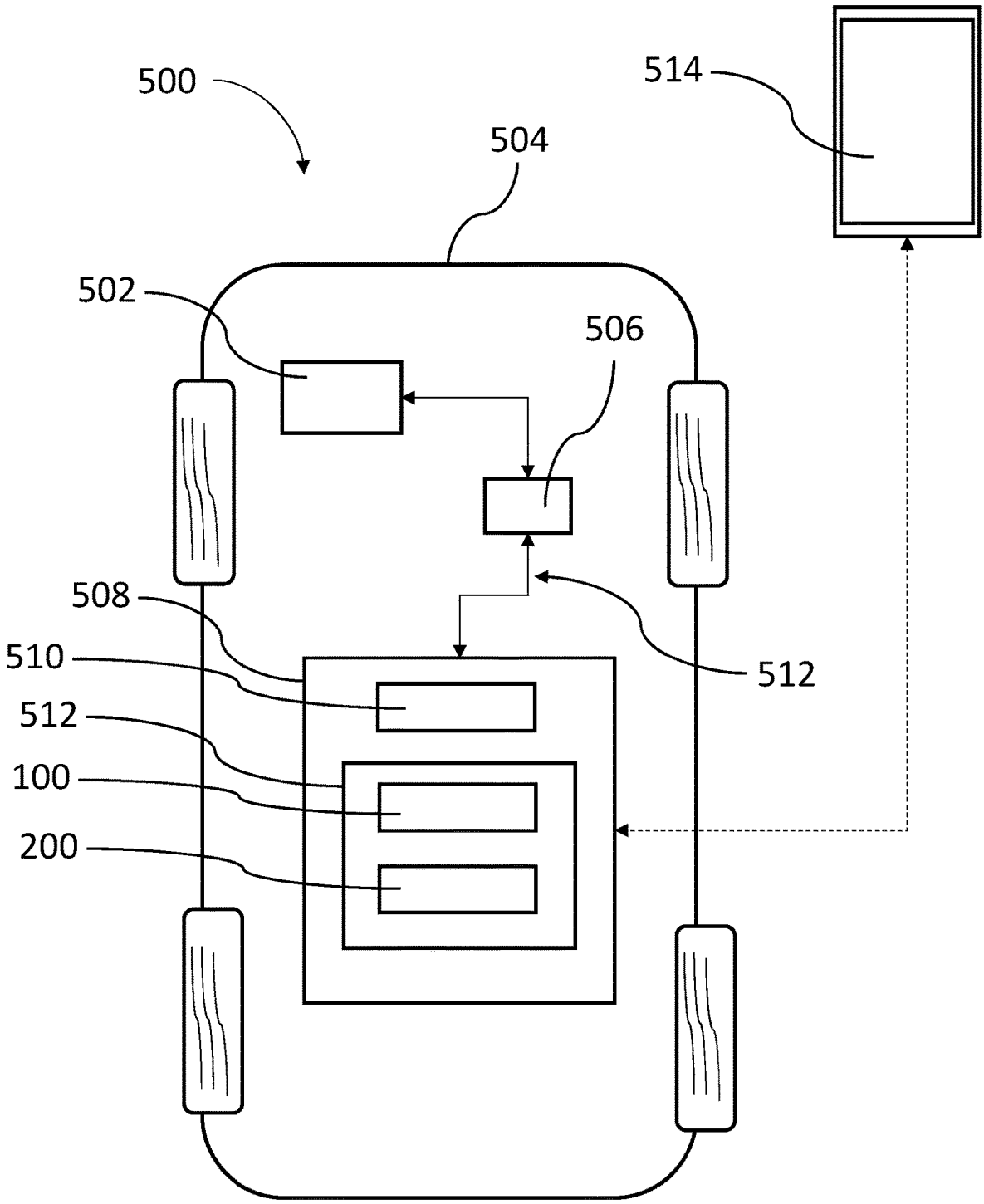
FIG. 5 is a functional diagram of a vehicle having an integrated vehicle health management system configured to implement the method of FIG. 1.

Referring to FIG. 5 is an integrated vehicle health management system (IVHMS), generally indicated by reference numeral 500, for implementing the method 100 of diagnosing an exhibited vehicle failure and suggesting least probable faults for the cause of the exhibited vehicle failure. The IVHMS includes a component sensor 506 configured to collect information from the vehicle component 502, a controller 508 in electronic communication with the component sensor 506, and a human-machine interface (HMI) 514 in electronic communications with the controller 508. The controller 508 collects information to monitor performance characteristics of various vehicle components and sub-systems and executes a VHM algorithm to predict failures in sub-systems by tracking deteriorating or failing performance. The VHM algorithm is preferably initiated for each ignition event and continues running for as long as the various vehicle components and sub-systems are running to determine SOH designations for such various vehicle components and sub-systems. The controller 508 analyzes the SOH designations in accordance with method 100 to suggest least probable faults for the cause of the exhibited vehicle failure.

The vehicle controller 508 communicates with the HMI 514 to communicate to a vehicle operator or technician suggesting least probable faults for the cause of the exhibited vehicle failure. In an exemplary embodiment, the controller 508 is located within the vehicle and communicates with the component sensors in the vehicle via a communications bus system 512. In another exemplary embodiment, the controller 508 is located remotely from the vehicle, in which the sensors within the vehicle 504 communicate with the communications bus system 512 within the vehicle and the controller 508 communicates with the communications bus via a wireless network (not shown).

The at least one component sensor 502 is configured to monitor the health of the at least one vehicle component 502. As a non-limiting example, the component 502 may be that of a vehicle battery 502 and the component sensor 506 is configured to monitor the operating parameters of the battery 502 that includes the state of charge, open circuit voltage, minimum crank voltage, crank time, and battery internal resistance. The component sensor 502 collects information on the operating parameters of the component 502 and communicates the information to a controller 508.

The controller 508 is a non-generalized, electronic control device having a preprogrammed digital computer or processor 510, memory 512 or non-transitory computer readable medium used to store data such as control logic, software applications, instructions, computer code, data, lookup tables, etc. Computer readable medium includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device. Computer code includes any type of program code, including source code, object code, and executable code.

A method and IVHMS for implementing the method of the present disclosure offers several advantages. The method tracks and keeps count of the number of consecutive Green SOH results from the VHM assessments to generate least probable cause determination for vehicle problems including sudden failures, intermittent faults or uncovered faults, or missing data issues with application to battery fault diagnosis, and delivers compelling vehicle component status information to the operator of the vehicle or service technician to bias the service technician away from potential inappropriate part replacements thereby reducing no trouble found (NTF) replacements, associated warranty costs, and in convenience to the customer.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A method of diagnosing a least probable cause for a failure exhibited by a vehicle, comprising:

initiating a vehicle health management (VHM) algorithm, by a vehicle controller, to monitor a state of health (SOH) for at least one vehicle component at a predetermined vehicle operating event over a predetermined time period, wherein the VHM algorithm determines at least one of a Green SOH, a Yellow SOH, and a Red SOH designation for the at least one vehicle component;

recording the Green SOH, the Yellow SOH, and the Red SOH designations over the predetermined time period;

retrieving the Green SOH, the Yellow SOH, and the Red SOH designations over the predetermined time period upon the failure exhibited by the vehicle; and calculating a number of Green SOH designations ($N_{calculated}$) over the predetermined time period;

issuing a least probable cause suggestion for the at least one vehicle component when predetermined conditions are met, wherein the predetermined conditions include (i) the calculated number of Green SOH designations ($N_{calculated}$) is equal to or greater than a predetermined N value and (ii) no Yellow SOH and Red SOH designations are present; and communicating, by the vehicle controller, the least probable cause suggestion to a human machine interface (HMI).

2. The method of claim 1, further comprising:

partitioning the predetermined time period into partitioned time intervals; and filtering out duplicates of the Green SOH, the Yellow SOH, and the Red SOH designations within a partitioned time interval.

3. The method of claim 2, further comprising determining a confidence level for the determined at least one of the Green SOH, the Yellow SOH, and the Red SOH designation for the at least one vehicle component.

4. The method of claim 3, further comprising:

determining a time gap, wherein the time gap is a predetermined number of consecutive partitioned time intervals without a SOH designation; and wherein the predetermined conditions further include (iii) the time gap having less than a predetermined value.

5. The method of claim 4, wherein $N_{calculated}$ is calculated using:

$$N_{Calculated}=(N_{Total}-N_{Before})$$

wherein:

$N_{Before}$ is a number of Green SOH designations before the time gap; and $N_{Total}$ is a total number of Green SOH designations over the predetermined time period.

6. The method of claim 4, wherein $N_{calculated}$ is calculated using:

$$N_{calculated}=[N_{Before}\times f(T)]+N_{After}$$

wherein:

$N_{Before}$ is the number of Green SOH designations before the time gap;

$N_{After}$ is the number of Green SOH designations after the time gap; and f(T) is a monotonically decreasing function with 0<= f(T)<=1, wherein T is a predetermined amount of time in the time gap.

7. The method of claim 4, wherein $N_{calculated}$ is calculated using:

$N_{calculated}=N_{Total}$ when the time gap is less than a predetermined number of consecutive time intervals and a consolidated confidence level above a predetermined value, wherein the consolidated confidence level comprises one of a minimal confidence level, a maximum confidence level, and an average confidence level of a group of the Green SOH confidence levels after the time gap;

wherein:

$N_{Total}$ is a total number of Green SOH designations over the predetermined time period.

8. The method of claim 4, further comprising:

determining when there are missing SOH designations over the predetermined time period;

wherein the predetermined conditions further include (iv) no missing SOH designation is present.

9. The method of claim 8, further comprising:

determining when there are any alerts for the at least one vehicle component over the predetermined time period;

wherein the predetermined conditions further include (v) no alerts for the at least one vehicle component are present.

10. The method of claim 9, further comprising:

manually inspecting the at least one vehicle component for visible faults;

wherein the predetermined conditions further include (vi) no visible faults are found.

11. A method of diagnosing and suggesting least probable cause for a failure exhibited by a vehicle, comprising:

initiating a vehicle health management (VHM) algorithm, by a vehicle controller, to monitor a state of health (SOH) for at least one vehicle component at a predetermined vehicle operating event over a predetermined time period, wherein the VHM algorithm determines at least one of a Green SOH, a Yellow SOH, and a Red SOH designation together with a corresponding confidence level for the at least one vehicle component;

calculating a number of Green SOH designations ($N_{calculated}$) over the predetermined time period; and upon the failure exhibited by the vehicle, displaying a least probable cause indication on a human machine interface (HMI) for the at least one vehicle component when a set of conditions are met, wherein the set of conditions include (i) the calculated number of Green SOH designations ($N_{calculated}$) is equal to or greater than a predetermined number of Green SOH designations and (ii) no Yellow SOH and Red SOH designations are present.

12. The method of claim 11, further comprising:

determining a maximum number of consecutive partitioned time intervals without a Green SOH designation;

wherein the set of conditions further includes (iii) the number of consecutive partitioned time intervals without a Green SOH designation is less than a predetermined number of partitioned time intervals.

13. The method of claim 12, further comprising:

determining a number of missing SOH designations over the predetermined time period;

wherein the set of conditions further includes (iv) the number of missing SOH designations is less than a predetermined value.

14. The method of claim 13, further comprising:

determining when there are any subsystem alerts over the predetermined time period;

wherein the set of conditions further includes (v) no subsystem alerts are present.

15. The method of claim 14, further comprising:

visually inspecting the at least one vehicle component for faults;

wherein the set of conditions further includes (vi) no visible faults are found.

16. The method of claim 11, wherein $N_{calculated}$ is calculated using at least one of equations:

$$N_{Calculated}=(N_{Total}-N_{Before}); \quad \text{(i)}$$

$$N_{calculated}=[N_{Before}\times f(T)]N_{After}, \text{ wherein } T=\text{a time gap; and} \quad \text{(ii)}$$

$$N_{calculated}=N_{Total} \quad \text{(iii)}$$

when the time gap is less than a pre-defined value and a group of Green SOH designations after the time gap includes a consolidated confidence level above a predetermined value, wherein the consolidated confidence level comprises one of a minimal confidence level, a maximum confidence level, and an average confidence level of the group of Green SOH confidence levels after the time gap;

wherein $N_{Total}$ is a total number of Green SOH designations over the predetermined time period;

$N_{Before}$ is a number of Green SOH designations before a time gap;

$N_{After}$ is a number of Green SOH designations after the time gap; and f(T) is a monotonically decreasing function with 0<=f(T)<=1, wherein T is the size of the time gap.

17. An integrated vehicle health management system (IVHMs) for a vehicle, comprising:

a component sensor configured to collect information from a vehicle component; and a controller in electronic communication with component sensor;

wherein the controller is configured to:

initiate a vehicle health management (VHM) algorithm to monitor a state of health (SOH) for at least one vehicle component at a predetermined operating event over a predetermined time period, wherein the VHM algorithm determines at least one of a Green SOH, a Yellow SOH, and a Red SOH designation for the at least one vehicle component;

calculate a number of Green SOH designations ($N_{calculated}$) over the predetermined time period; and upon a failure exhibited by the vehicle, provide a least probable cause indication for the at least one component when a predetermined set of conditions are met;

wherein the predetermined set of conditions includes (i) the calculated number of Green SOH designations ($N_{calculated}$) is equal to or greater than a predetermined number of Green SOH designations; and (ii) no Yellow SOH and Red SOH designations are present.

18. The integrated vehicle health management system (IVHMS) of claim 17, further comprising:

a human machine interface, (HMI) in communication with the controller;

wherein the least probable cause indication is displayed on the HMI.

19. The integrated vehicle health management system (IVHMS) of claim 17, wherein the controller is located apart from the vehicle and the controller is in wireless electronic communication with component sensor.

* * * * *